United States Patent [19]

Cartesse

[11] 4,431,254

[45] Feb. 14, 1984

[54] CONNECTOR ELEMENT FOR AN ARMOURED CABLE WITH TWO MULTICO-CORE CONDUCTORS

[75] Inventor: Georges Cartesse, Le Blanc Mesnil, France

[73] Assignee: Societe Generale pour l'Industrie Electronique (S.O.G.I.E.), Rosny-sous-Bois, France

[21] Appl. No.: 312,794

[22] Filed: Oct. 19, 1981

[30] Foreign Application Priority Data

Oct. 20, 1980 [FR] France ..... 80 22409

[51] Int. Cl.[3] ..... H01R 17/18

[52] U.S. Cl. ..... 339/177 R

[58] Field of Search ..... 339/177 R, 177 E, 89 C, 339/90 C, 91 C, 94 P; 174/75 C, 88 C

[56] References Cited

U.S. PATENT DOCUMENTS 3,701,086 10/1972 Somerset ..... 339/177 R 3,870,047 3/1975 Ganser ..... 339/177 E 4,307,926 12/1981 Smith ..... 339/177 R

*Primary Examiner*—Eugene F. Desmond

*Assistant Examiner*—David L. Pirlot

*Attorney, Agent, or Firm*—Brisebois & Kruger

[57] ABSTRACT

This invention concerns a connector element for armoured cable with two multi-core conductors.

The element comprises a peripheral housing forming the earth contact, to which is fixed the braiding the of the cable, and an exterior contact socket is mounted co-axially in the housing and is rigid with a shank to which is fixed the bared extremity of one of the conductors of the cable, a central axial contact, rigid with the shank to which is fixed the bared extremity of the second conductor of the cable, the shanks of the exterior contact and the central contact being aligned, preferably along the axis of the conductor element, the shanks and conductor contacts of the connector element being separated from one another by insulators.

9 Claims, 3 Drawing Figures

CONNECTOR ELEMENT FOR AN ARMOURED CABLE WITH TWO MULTICO-CORE CONDUCTORS

The present invention relates to a connector element for an armoured cable with two multi-core conductors.

There are currently used, particularly in the aeronautical industry, lines consisting of such cables comprising two multi-core conductors each one surrounded by a sheath, and a peripheral braiding formed from at least one layer the whole being secured in a plastic covering.

When the cable comprises two braidings these are separated from one another by a metallic immunity layer.

The connector elements currently known for such cables comprise in a housing, forming an earth contact, and connected to the braiding of the cable, two contacts in the form of male rods or female sockets spaced in the diametral plane of the housing, each of the contacts being rigid with a shaft in which is fixed one of the multicore conductors beared to the cable.

Such conductor elements are for example sold by Radiall S.A. under references BR2 or BD2.

These connector elements while functioning very satisfactorily have the inconvenience of necessitating an angular orientation during coupling, which makes it more difficult and time consuming. Moreover, the diameter of the housing must be relatively large by reference to the space necessary for the two contacts in the diametrical plane.

The present invention proposes to provide connector elements for armoured cables with two multi-core conductors, which have an economic cost price, and avoid the disadvantages mentioned above of known connector elements.

The connector element according to the invention is characterised essentially by the fact that it comprises a peripheral housing in the form of a socket, forming the earth contact, to which is fixed the braiding of the cable, an exterior contact socket mounted coaxially in the housing and rigid with the shank to which is fixed the bared extremity of one of the conductors of the cable, a central axial contact rigid with a shank to which is fixed the bared extremity of the second conductor of the cable, the shanks of the exterior contact and the central contact being aligned, preferably along the axis of the connector element, the shanks and conductor contacts of the connector element being separated from one and another by insulators.

The central contact is a rod in the case of a male connector or an elastic socket in the case of a female connector element.

It can thus be seen that the connector element according to the invention has three concentric contacts connected respectively to the braiding of the cable and to its two conductors.

It is due to this concentric disposition of the contacts that it is possible to avoid the positioning problems connected with the angular orientation of the contacts of elements of connectors currently known. Moreover, the co-axial conformation permits the reduction of the exterior diameter of the connector element. In addition the components are of revolution, which facilitates their obtention and reduces the cost of manufacture.

Advantageously the exterior contact shank is fixed by screwing on the casing on the socket of the exterior contact and is disposed behind the shank of the central contact. The shank of the exterior contact has advantageously a tabular piece for fixing on a conductor and extending from a cylindrical body having a longitudinal slot for the passage of multi-core conductor intended to be fixed on the shank of the central contact. A longitudinal slot is equally made in the insulator interposed between the tubular piece of the shank of the exterior contact and the housing forming the earth socket.

Other advantages, and characteristics of the connector element according to the invention, as well as its process of assembly to the extremity of an amoured cable with two-multi-core conductors will now be shown in the following description by way of example in which:

FIG. 1 shows an example of armoured cable on which can be mounted the conductor element according to the present invention.

Figure 1:
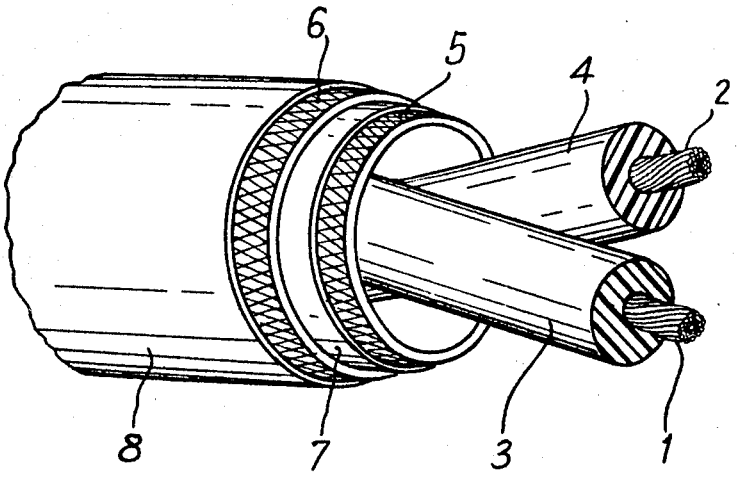
FIG. 1 represents the extremity of an amoured cable with two multi-core conductors usable with the invention.

This cable comprises two multi-core conductors 1 and 2 each covered with an insulating sheath 3 and 4 respectively.

The cable includes a reinforcement consisting of two metallic braidings 5 and 6 separated by a metallic immunity strip 7. The cable also has a peripheral plastics protection sheath 8.

Figure 2:
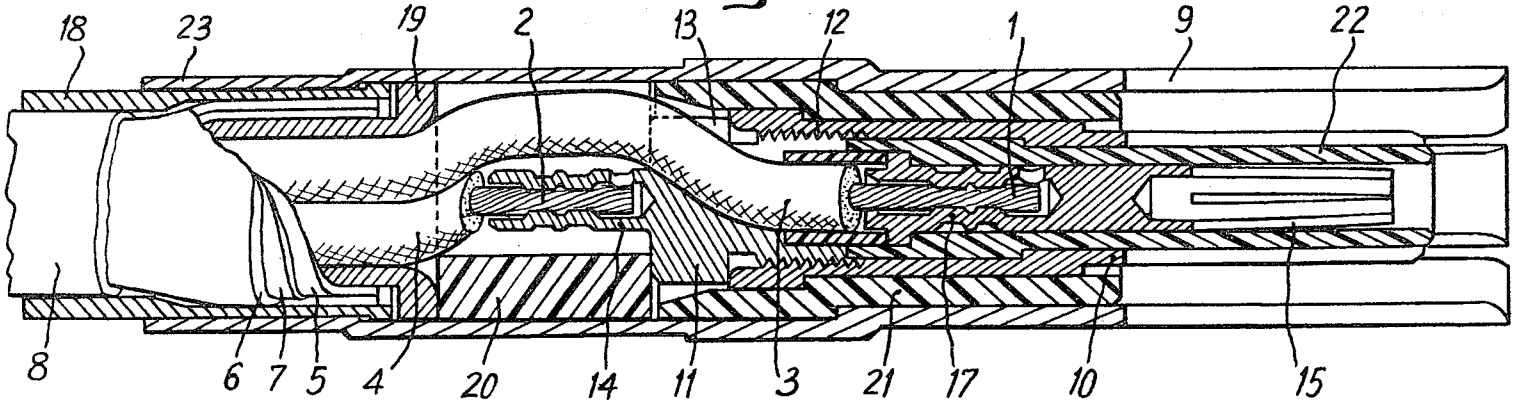
FIG. 2 represents in section a connector element of female type mounted at the extremity of such a cable.
Figure 3:
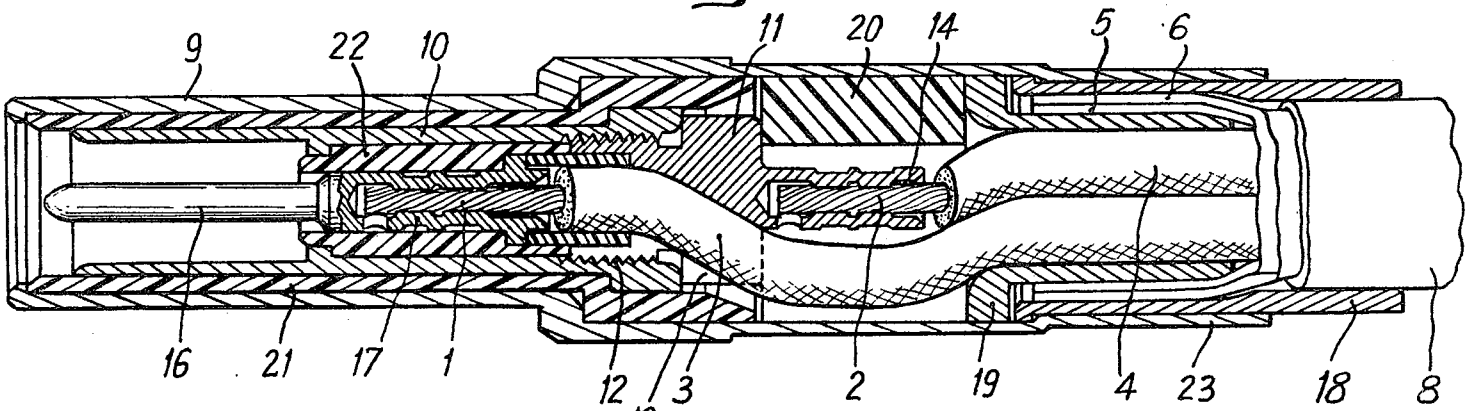
FIG. 3 represents in section, a connector element of the male type.

Reference is now made to FIGS. 2 and 3 which represent in section connector elements according to the invention, one female (FIG. 2) and the other male (FIG. 3).

Each of the connector elements comprises a fixed or elastic peripheral earth socket 9 and a fixed or exterior elastic contact socket 10 mounted co-axially in the socket 9, the exterior contact socket 10 being rigid with a shank 11. The rigid coupling of the shank 11 and the exterior socket 10 is effected by the intermediary of a screw-thread 12. In the example shown all the elastic contacts are on the female connector (FIG. 2) and all the fixed connectors are on the male connector (FIG. 3).

The shank 11 of exterior contact is in the form of a cylindrical body provided with a longitudinal slot 13 and extended by a tubular axial piece 14.

The connector element comprises also a central contact in the form of an elastic socket 15 for the female element of FIG. 2 or in the form of an axial rod 16 for the male element of FIG. 3. Each central contact 15 or 16 is rigid with a tubular axial shank 17. The sheath and the braiding of the cable may be maintained by ferrule 18 for guiding the sheath of the cable and by a braided annular clip ring.

Finally the connector element comprises insulators between the different electrical conducting components.

It is also possible to have insulator 20 between the peripheral socket 9 and the tubular piece 14 axial with shank 11 of the exterior socket, this insulator 20 having a longitudinal slot in order to facilitate the assembly of the connector element as will be explained below.

An insulator 21 is mounted between the socket 9 and the exterior socket 10, and an insulator 22 is mounted between the central contact 5 and 6 respectively and the socket of the exterior contact 10.

In order to assemble a connector element according to the invention at the extremity of an armoured co-axial cable with two multi-core conductors the following procedure is followed.

First, the beared end of conductor 2 is fixed, preferably by crimping with the aid of an appropriate tool, or by soldering or by any appropriate means, on the tubular piece 14 of the shank of exterior contact 11.

Then is fixed, preferably by crimping with the aid of the same tool, the bared extremity of conductor 1 on the shank 17 of the central conductor, the sheath 3 of conductor 1 passing into the longitudinal slot 13 of shank 11.

Then are put in place successively the socket of exterior contact 10 screwing it on the shank 11 with the interposition of insulator 22, then the socket of peripheral contact 9 with the interposition on insulators 21 and 20, insulator 20 being put in place radially, its longitudinal slot serving to house on the one hand the extremity piece 14 of the shank 11 to which is fixed, preferably by crimping the conductor 2 and the sheath 3 of conductor 1 connected to shank 17 of the central contact.

Then is fixed particularly with the aid of crimping for example hexagonally to the extremity 23 of the peripheral earth socket 9, this taking place on the cable after the interposition of the ferrule 18 and of the braided clip ring 19.

While the invention has been described with the methods of particular construction it is evident it is not thus limited and that numerous variants and modifications can be applied to it without going beyond its scope or its spirit.

I claim:

1. A connector for armoured cable with at least two conductors, comprising a peripheral housing in the form of a socket forming an earth contact for connection to braiding of the cable, an exterior contact socket mounted co-axially in the housing and rigid with a shank for connection to a bared extremity of one of the conductors of the cable, a central axial contact rigid with a shank for connection to a bared extremity of a second conductor of the cable, the shanks of the exterior contact and the central contact being substantially aligned along the axis of the connector in longitudinal co-linear relationship, the respective shanks and conductor contacts of the connector being insulated from one another.

2. A connector according to claim 1 which is of the male type and in which the central contact is an axial rod.

3. A connector according to claim 1 wherein said connector is connectable to a mating connector at various angular positions.

4. A connector according to claim 1 which is of the female type and in which the central contact is an elastic socket mounted co-axially of the housing.

5. A connector according to any one of the preceding claims in which the shank of the exterior contact is fixed by screwing the socket of the exterior contact on the shank, and the exterior contact shank is disposed behind the shank of the central contact.

6. A connector according to claim 5 in which the shank of the exterior contact comprises a cylindrical body having a longitudinal slot, and a tubular conductor connection portion extending from said body.

7. A connector according to claim 5 comprising a slotted longitudinal insulator between the tubular fixing piece of the shank of the exterior contact and the housing forming the earth contact.

8. A connector according to claim 1 wherein said shanks are each tubular, and each shank comprises means for connection to a bared end of a conductor inserted therein.

9. A connector according to claim 8 wherein said shanks are each deformable, and each shank comprises means for crimp connecting to a bared end of a conductor inserted therein.

* * * * *